United States Patent [19]

Hoenig

[11] Patent Number: 4,670,026

[45] Date of Patent: Jun. 2, 1987

[54] METHOD AND APPARATUS FOR ELECTROSTATIC EXTRACTION OF DROPLETS FROM GASEOUS MEDIUM

[75] Inventor: Stuart A. Hoenig, Tucson, Ariz.

[73] Assignee: Desert Technology, Inc., Marana, Ariz.

[21] Appl. No.: 830,540

[22] Filed: Feb. 18, 1986

[51] Int. Cl.[4] ..... B03C 3/04; B03C 3/41

[52] U.S. Cl. ..... 55/11; 55/2; 55/131; 55/135; 55/152; 55/154; 55/DIG. 38; 55/137

[58] Field of Search ..... 55/11, 2, 135, 137, 55/152, 154, 131, DIG. 38

[56] References Cited

U.S. PATENT DOCUMENTS

| | | | |
|---|---|---|---|
| 636,304 | 11/1899 | Vosmaer | 55/152 X |
| 1,035,422 | 8/1912 | Cottrell et al. | 55/152 X |
| 1,130,212 | 3/1915 | Steere | 55/152 X |
| 1,356,196 | 10/1920 | Duffy | 55/11 |
| 1,393,712 | 10/1921 | Steere et al. | 55/135 X |
| 1,888,606 | 11/1932 | Nesbit | 55/152 X |
| 2,192,250 | 3/1940 | White | 55/137 X |
| 2,615,530 | 10/1952 | Hodson et al. | 55/135 X |
| 2,983,332 | 5/1961 | Vicard | 55/11 X |
| 3,124,437 | 3/1964 | Lagarias | 55/13 |
| 3,157,479 | 11/1964 | Boles | 55/152 X |
| 3,495,379 | 2/1970 | Hall et al. | 55/2 |
| 3,750,373 | 8/1973 | Olson | 55/152 X |
| 3,826,063 | 7/1974 | Festner | 55/128 |
| 3,890,103 | 6/1975 | Konishi | 23/284 |
| 3,898,468 | 8/1975 | Guerin | 55/152 X |
| 4,042,354 | 8/1977 | Tully | 55/152 X |
| 4,066,526 | 1/1978 | Yeh | 55/2 X |
| 4,072,477 | 2/1978 | Hanson et al. | 55/10 |
| 4,094,653 | 6/1978 | Masuda | 55/138 |
| 4,098,591 | 7/1978 | Van Diepenbroek et al. | 55/2 |
| 4,194,888 | 3/1980 | Schwab et al. | 55/2 |
| 4,264,343 | 4/1981 | Natarajan et al. | 55/126 |
| 4,279,625 | 7/1981 | Inculet et al. | 55/131 |
| 4,305,909 | 12/1981 | Willett et al. | 55/11 X |

FOREIGN PATENT DOCUMENTS

| | | | |
|---|---|---|---|
| 564430 | 11/1932 | Fed. Rep. of Germany | 55/135 |

*Primary Examiner*—Kathleen J. Prunner

*Attorney, Agent, or Firm*—Cahill, Sutton & Thomas

[57] ABSTRACT

An apparatus for extraction of water droplets from air includes a corona array including an array of conductive pointed needles with a high voltage thereon adjacent to a grounded conductive collector. Water droplets are exposed to a strong electrostatic field gradient, causing water droplets in incoming air to rotate and move along the electric field gradient lines toward the shanks of the needles and coalesce thereon, forming larger droplets. The droplets move under the influence of an increasing field gradient toward the needle points, acquiring electrostatic charge from the needle. The droplets eventually are repelled from the needles, when electrostatic repulsion forces on the droplets exceed adhesion forces that decrease as the droplets increase in size during their migration. The repulsed droplets move under the influence of electric field to the collector. The resulting liquid accumulating on the collector is removed to reduce re-evaporation into the air. In one embodiment, the temperature of the needles are kept below the condensation point, and polar water molecules are directed by the gradient to the needle shanks.

22 Claims, 8 Drawing Figures

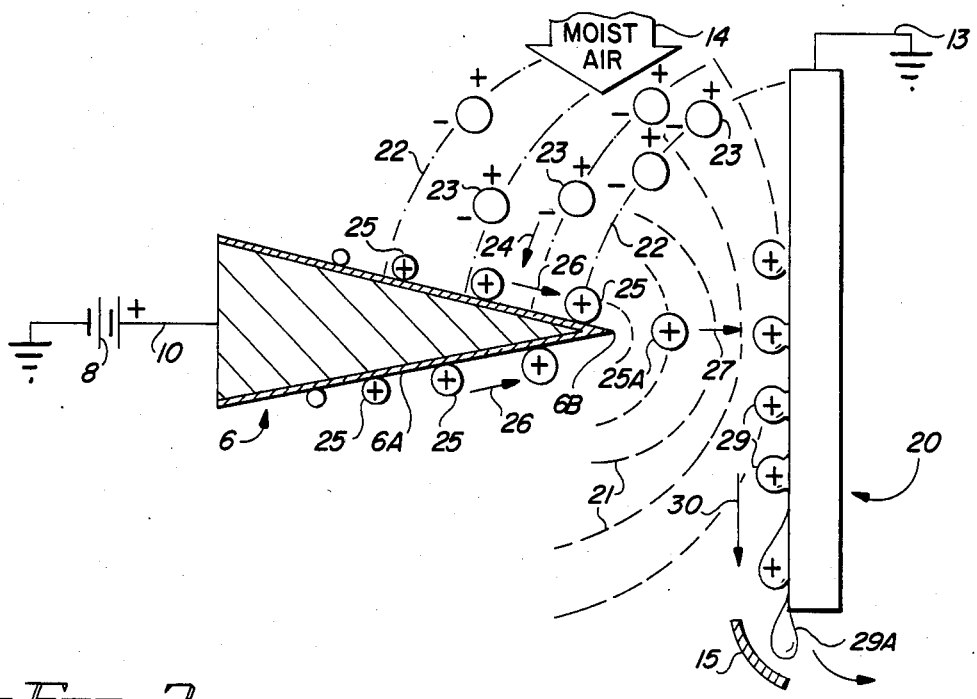
FIG. 2
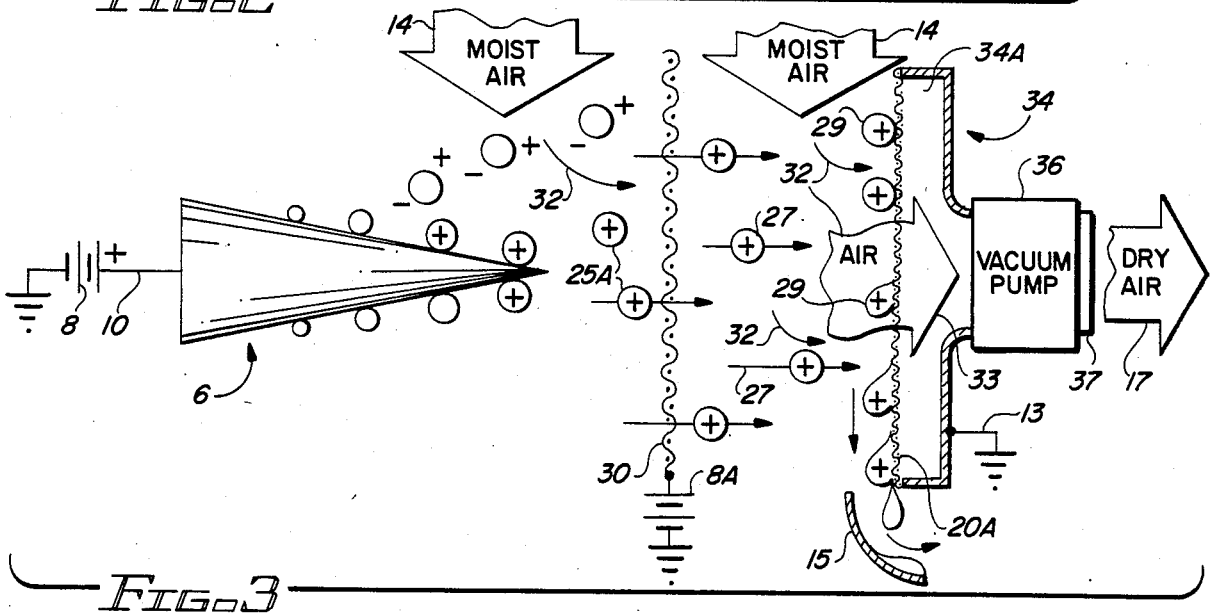
FIG. 3
FIG. 4
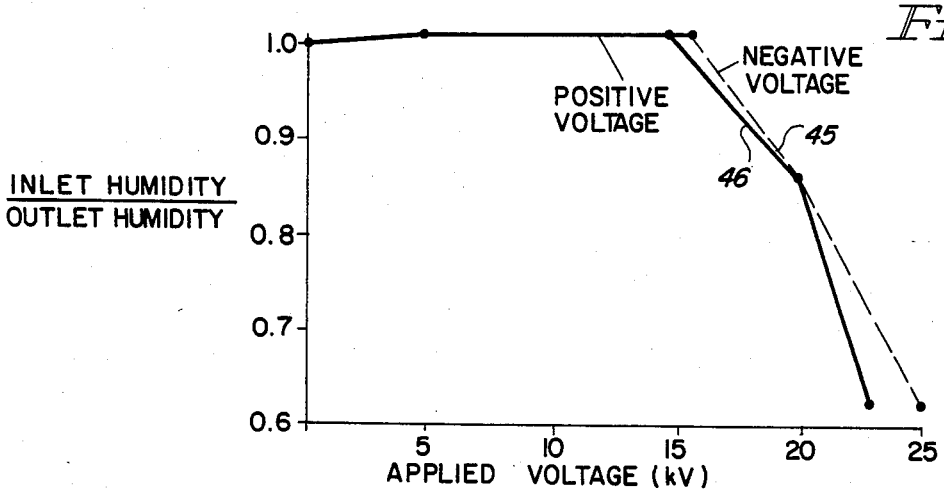

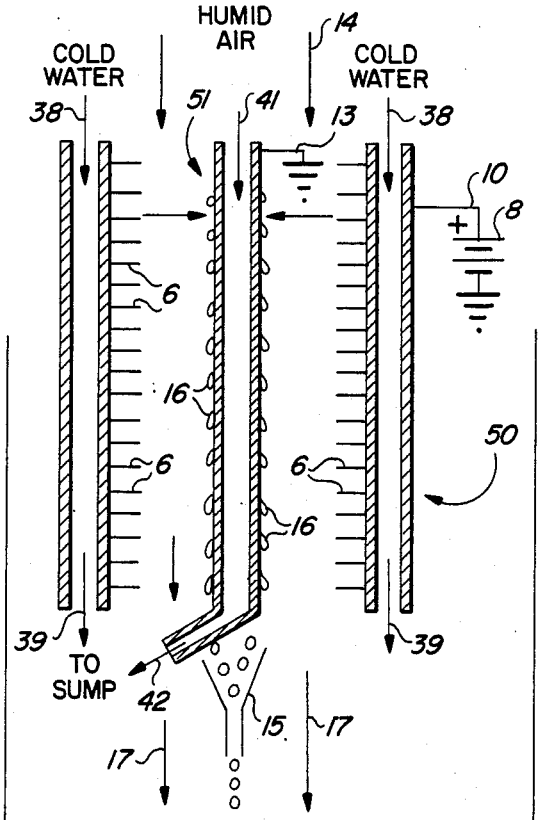
FIG. 5
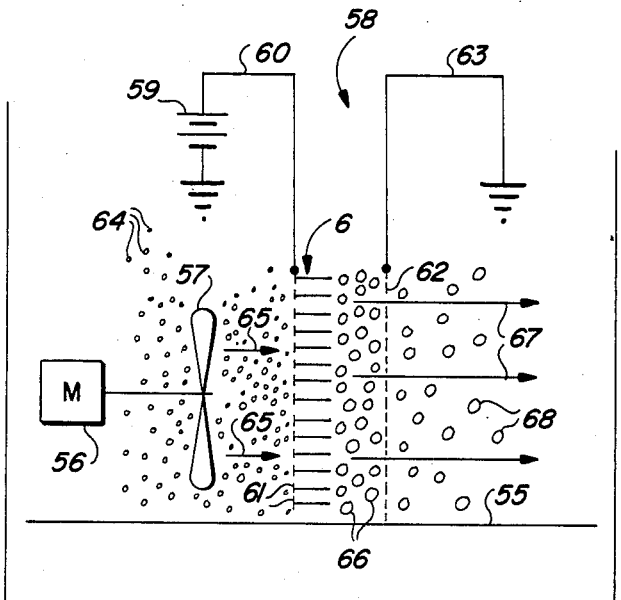
FIG. 6
FIG. 7
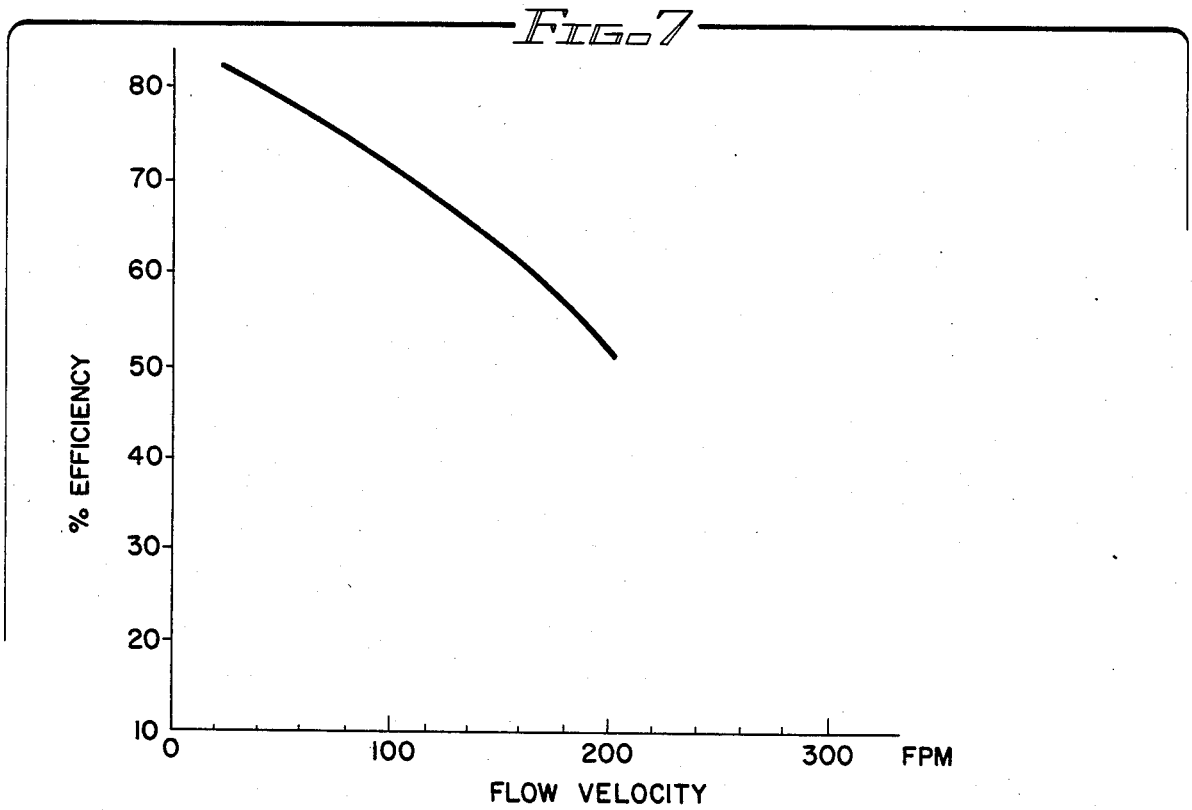

METHOD AND APPARATUS FOR ELECTROSTATIC EXTRACTION OF DROPLETS FROM GASEOUS MEDIUM

BACKGROUND OF THE INVENTION

The invention relates to devices for removing water vapor from air, and more particularly to electrostatic devices for removing droplets from gaseous mediums without expenditure of large amounts of energy.

The requirement for removal of water vapor from air to improve comfort is well-known. One known method of removing water vapor to reduce the relative humidity of air is to pass the humid air through absorbent or hydroscopic drying material that eventually becomes saturated. The saturated drying material must be discarded or recycled by heating, using a significant amount of energy, before reuse. Other techniques for removal of water vapor or other vapor from air, such as removal of organic vapors from dry cleaning and painting operations, involve the use of activated charcoal or zeolite absorbents that have limited capacity and must be recycled by heating. Passing moist air through refrigerated coils to condense the vapor from the air is another known technique for reducing the relative humidity of air. This technique requires a large amount of energy to compress the refrigerant gas and then pass it through cooling coils to induce condensation of high pressure refrigerant gas to its liquid state. The condensed liquid then is allowed to expand back into the gas phase thereby taking heat from air that is to be cooled to the dew point to induce condensation of water.

All of the above processes require substantial amounts of energy and contribute to the cost of dehumidifying air. As will be explained, an advantage of the present invention is that the air need not be cooled in order to remove the moisture therefrom.

Electrostatic precipitators commonly have been used to remove particles from an air stream or gas stream in many industrial discharge processes to prevent contamination of the atmosphere. Electrostatic precipitators typically include corona discharge arrays that include a large array of closely spaced, conductive pointed needles and a conductive collector to produce strong electrostatic field gradients. The high electric fields ionize or charge minute particles in air or gas passing through the systems. The ionized particles then migrate and adhere to the conductive collector.

The collected particles may be removed by shaking the collector or spraying it with water. If high resistivity particles (e.g., Western fly ash) are to be collected, water may be sprayed into the system during the charging/collection operation to induce particle agglomeration and reduce the electrical resistance of the collected dust. The state-of-the-art is generally indicated in U.S. Pat. Nos. 4,264,343, 4,194,888, 4,094,653, 4,072,477, 3,890,103, 3,826,063, 3,124,437, 1,393,712 and 1,130,212 and French Patent No. 2.229.468.

U.S. Pat. No. 3,750,373 by Olson discloses a structure for removing mist from a gas stream, in which moisture laden gas passes through tubes containing a helical wrap of Starr type wire having a plurality of outwardly directed points thereon and disposed within conductive tubes. An electric field applied between the housing and the wire causes minute droplets constituting the mist to form larger droplets that fall to the bottom of the housing and are collected and drained away.

In the system of U.S. Pat. No. 3,750,373, the "mist" consists of small droplets of liquid water. These "mist" droplets can be induced to agglomerate into large drops quite easily and are thereby removed from the airstream.

There is believed to be a wide variety of uses for a low cost, low energy consumption device for removing mist, and from air and gases. Up to now, however, no commercially viable technique other than use of the above-mentioned absorbent materials or refrigerated coils to promote condensation has been demonstrated.

SUMMARY OF THE INVENTION

Accordingly, it is an object of the invention to provide an inexpensive, low energy consumption apparatus and method for removing polar molecules, mist or microdroplets from a gaseous medium.

It is another object of the invention to provide an economical, low energy consumption technique for providing fresh water from a moist atmosphere.

It is another object of the invention to provide a low cost apparatus and method for dehumidifying air.

Briefly described, and in accordance with one embodiment thereof, the invention provides an apparatus and method for removing polar molecules and/or microdroplets from a gaseous medium by passing the gaseous medium through a corona discharge array, with electrical potentials applied to the corona discharge array of sufficient magnitude that molecules or microdroplets having a dipole moment rotate in the direction of the electrical field and then move along electric field lines to the shanks of conductive sharp needles of the corona discharge array, and coalesce thereon, forming larger droplets.

In one embodiment of the invention, water microdroplets in the gaseous medium are drawn to the needles and coalesce in the form of larger microdroplets thereon. The microdroplets on the shanks of the needles of the corona discharge array acquire electrical charge and move under the influence of the electrical field to higher electrical field intensity regions near the sharp tips of the needles. The microdroplets increase in size and acquire electrical charge from the needle until the resulting electrostatic repulsion forces exceed the adherent forces holding the microdroplets on the needle shanks. The microdroplets then are repelled from the tip portion of the needle, and then move under the influence of the electric field to and adhere to a conductive collector plate.

The microdroplets become droplets on the collector plate and move under the influence of gravity downward or are otherwise removed and flow into a suitable collector, to prevent re-evaporation into the gaseous medium. The gaseous medium then is exhausted, and has a substantially reduced content of the microdroplets.

In the described embodiment of the invention, either the positive or negative potentials (relative to the grounded conductive collector) are applied to the needles of the corona discharge array. Positive potentials on the needles reduce ozone production to some extent as the mist is removed from incoming air having high relative humidity. In a described embodiment of the invention, the corona discharge array includes a plurality of radial spaced, pointed conductive needles arranged around a cylindrical center electrode that is concentric with and spaced from a conductive cylindrical collector surface that is electrically grounded relative to the voltage applied to the conductive needles.

Alternately, sharp conductive needles pointing radially inward can be provided on the conductive cylindrical surface, and the coaxial center rod can function as a collector. In one embodiment of the invention, porous accelerator electrodes or screens at intermediate voltages are disposed between the conductive collector and the pointed tips of the needles to increase the electric field in order to accelerate the droplets toward the collector.

In another described embodiment of the invention, the collector surface is porous, so as to allow incoming air to be drawn through it while leaving collected droplets on the collector surface, in order to prevent re-evaporation of the droplets on the inner surface of the collector.

In another embodiment of the invention, a continuous spiral opening into a spiral tube is provided on an inner surface of the conductive collector to accumulate droplets as they move downward along the conductive collector surface under the influence of gravity. The spiral tube guides the collected liquid to a suitable container. This removes droplets from the collector soon after they are collected and prevents them from being re-evaporated. Various hydrophilic, hydrophobic or hydroscopic coatings for the needles are described to improve the efficiency of the device. Several configurations of the corona discharge array for various applications, that might be used for removing mist from large volumes of air are described.

BRIEF DESCRIPTION OF THE DRAWINGS

FIG. 2 is a schematic diagram useful in describing the physical operation of the invention to condense microdroplets on the corona discharge array.

FIG. 3 is an alternate structure that enhances acceleration of droplets from the corona discharge needles to the collector and an alternate collector structure.

FIG. 4 is a graph illustrating experimental results obtained in using the apparatus of FIG. 1.

FIG. 5 is a section view of another alternate embodiment of the dehumidification apparatus of the present invention.

FIG. 6 is a section view of a fog removing apparatus in accordance with the present invention.

FIG. 7 is a graph showing the efficiency of the fog removal apparatus of FIG. 6 as a function of the velocity of the incoming air.

DESCRIPTION OF THE INVENTION

Figure 1:
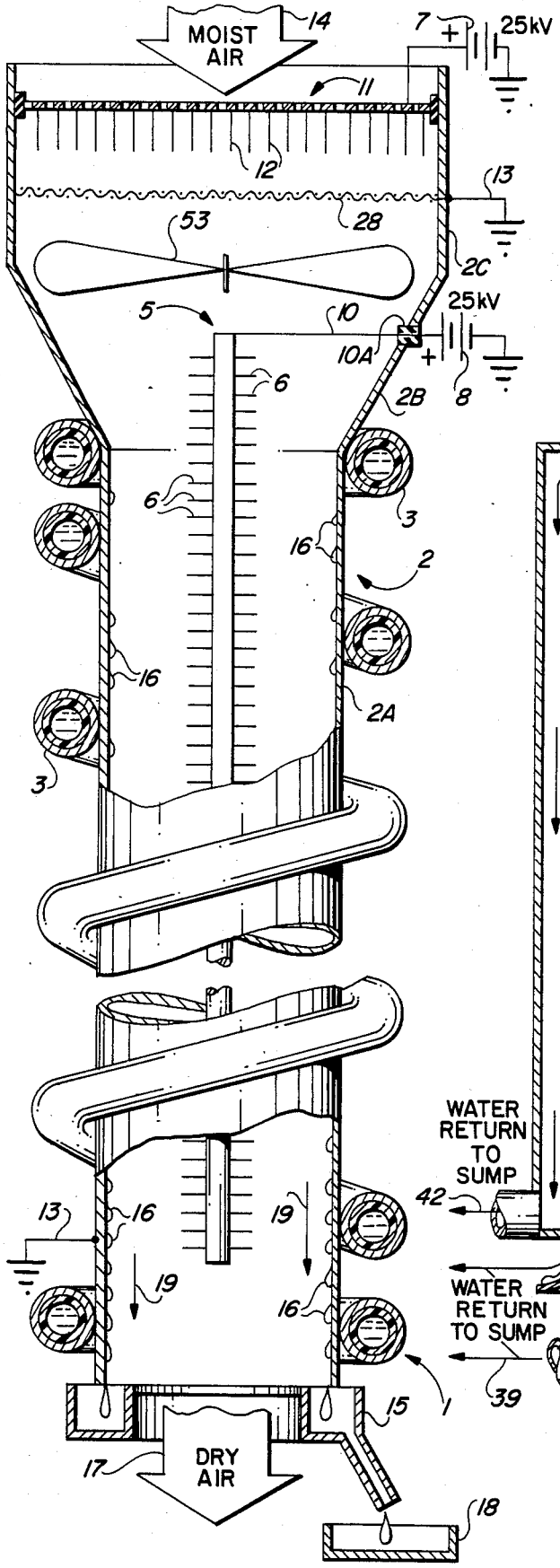
FIG. 1 is a section view of a dehumidification apparatus of the present invention.

Referring now to the drawings, particularly to FIG. 1, electrostatic moisture extraction system 1 includes a grounded conductive housing 2 having a lower cylindrical portion 2A, a frusto-conical transition section 2B, and a larger diameter upper section 2C. Housing 2 is electrically grounded by means of conductor 13. A center electrode 5 is supported concentrically within housing 2. Suitable insulators (not shown) are utilized to support center electrode 5. Center electrode 5 includes an array of radial, closely spaced conductive sharp pointed needles or the like, generally designated by reference numeral 6. The center electrode and the needles 6 are hereafter referred to collectively as "corona discharge array 5". Corona discharge array 5 is connected by an electrical conductor 10 extending through an insulative feedthrough 10A in housing 2 to a high voltage supply 8.

An optional upper corona discharge array designated by reference numeral 11 has a plurality of sharp conductive needles 12 connected thereto. The corona discharge array 11 includes an electrically grounded porous screen 28. Corona discharge array 11 provides an insulated support for the needles 12, and applies a suitable high voltage thereto by means of a conductor. The conductor is coupled to one electrode of a high voltage power supply 7.

A spiral cooling tube 3 is wound around the outer surface of the lower portion 2A of housing 2 to cool the surface thereof, for reasons explained subsequently. Humid inlet air designated by arrow 14 is forced or drawn into housing 2 and passes through both corona discharge array 11 and corona discharge array 5. In the subsequently described process, water droplets 16 are generated and collected on the inner surface of cylindrical section 2A of housing 2. The droplets slide downward, as indicated by arrows 19, and fall into an annular drip tray 15, from which they are collected in a container or sump 18. Relatively dry outlet air 17 is exhausted from the bottom of the tube 2A.

The basic operation of the electrostatic moisture extraction device of FIG. 1 best can be described by referring to the schematic diagram of FIG. 2, which shows one of the corona discharge array needles 6 and a portion of the conductive droplet collector wall designated by reference numeral 20. Where appropriate, similar reference numerals are used in FIGS. 1 and 2. It is well-known that the intensity of the electrical field produced at a sharp point is higher than elsewhere along a conductor. Reference numeral 21 designates equi-potential lines associated with corona discharge needle 6. Reference numeral 6A designates an optional coating of material that can be provided on the surface of needle 6 to possibly improve operation. The coating 6A could be a hydrophilic, hydroscopic, or hydrophobic material.

A hydrophilic coating could be a cloth-like material that would have a very small liquid/solid contact angle and allow water to spread over the surface. It is believed that this could enhance the formation of larger droplets from the mist. A hydrophobic material (e.g., Teflon) has a very large liquid/solid contact angle and the condensed liquid would tend to form droplets that could move rapidly to the needle tip for ejection toward the collector. It is believed that a hydroscopic material would absorb water vapor from the gas and could enhance the process of conversion of the mist to the liquid. It also is believed that using the proper coating 6A on the needles 6 may enable the droplets 25 (FIG. 2) to be removed from the needles 6, as subsequently explained, with use of less electrical energy.

As those skilled in the art know, electric field gradient lines such as 22 are normal to equi-potential lines such as 21. It is known that microdroplets have a dipole moment associated with separate, spaced concentrations of positive and negative charge in the presence of an electric field, and will move along an electric field line in the direction of an increasing gradient.

In accordance with the present invention, a suitably high voltage is produced on conductor 10 by high voltage power supply 8. The optimum value of voltage produced by high voltage power supply 8 depends upon the spacing between the pointed tip 6B of conductive needle 6 and the surface of grounded conductive conductor 20, and also to some extent on other factors, such as the velocity of incoming moist air 14.

The velocity effects are associated with the "time" required for the vapor condensation process. Once the larger droplets are formed on the needles, they must migrate toward the needle tips and then be ejected into the gas medium to travel to the collector. As the gas medium velocity in the system increases, there may be insufficient time for all of these effects to occur, and the efficiency of the system may decrease.

In accordance with the present invention, each of the mist microdroplets such as 23 rotate so that its dipole moment is oriented in the direction of the increasing electric field gradient. Since the negative charge concentration then is closer to the positive needle 6, the electrostatic attractive force between the positive needle and the negative end of the microdroplet exceeds the repulsive force between the needle 6 and the more distant positive portion of the microdroplet. The microdroplet therefore moves in the direction indicated by arrow 24 along the electric field line 22. As many microdroplets thus move toward the shank of needle 6, they accumulate and condense, forming larger droplets.

In accordance with the present invention, after droplets 25 coalesce along the shank of needle 6, the increasing intensity of the electrical field with respect to decreasing distance to the pointed tips 6B causes the droplets 25 to migrate toward the needle tip 6 where the field is most intense, as indicated by arrow 26. As the droplets continue to grow they acquire a positive charge by transfer of electrons to the needles, and are therefore exposed to a repulsive force. When the droplets become large enough, this repulsive force exceeds the natural adhesion of the droplets to the needle surface, and they are "thrown off" into the gas phase.

At this time, the repulsion force between the positively charged needle and the positively charged droplets "pushes" the droplets to the collector.

If the needles have a negative potential with respect to the collector, as shown in FIG. 1B, the process is the same except that the charges involved are negative, rather than positive.

It should be noted that one of the problems associated with the use of high voltage electric fields is the fact that ozone gas is frequently produced. In many environments, the presence of ozone is undesirable, because it is a strong oxidant. In accordance with the present invention, such ozone contamination can be greatly reduced by applying the high voltage to the needles, rather than to the collector. Then, the ozone molecule tends to attract electrons from the corona discharge to form ozone ions. Thus, the grid of positively charged wires or needles 6 in FIG. 1 will scavenge the ozone ions from the discharged air flow of the apparatus of FIG. 1. If the surfaces of the needles 6 are coated with one of several oxides, such as iron oxide, the ozone molecules will be catalysed to oxygen molecules.

The expelled droplets 25A, which have acquired positive charge from the needle 6, then are attracted to the relatively negatively charged grounded collector 20. The droplets therefore move in the direction of arrow 27 toward the surface of grounded collector plate 20 and accumulate thereon, as indicated by arrow 29. The force of gravity upon the accumulated droplets 29 causes them to move downward, as indicated by arrows 30. They fall from the bottom of collector plate 20 into a drip tray or skimmer, as indicated by reference numerals 15 and 29A.

Thus, in the basic operation of the device, the electrostatic field within the corona discharge array both causes coalescence of mist microdroplets on the shank of the needle, induces the movement of water droplets from the shanks of the needles to the tips and enhances collection of the repulsed droplets.

The electrostatic moisture extraction system shown in FIG. 1 was constructed and tested. The lower corona discharge array 5 and the upstream corona discharge array 11 have been separately operated, but not simultaneously operated to date.

The heighth of the conductive collector column 2A is approximately 40 inches, and the diameter thereof is approximately 4 inches. The center electrode 5 consists of a 40 inch length of copper rod having the array of radial "needles" 6 formed thereon. In the embodiment of the invention constructed and tested, the needles were formed by gouging slender "shavings" of copper out of the body of the rod by a company that markets the rods as "spined tubes" under the trademark HEATRON. The spines or needles are approximately three-eighths of an inch long. In the constructed and tested device shown in FIG. 1, the distance between the ends of the needles 6 and the conductive inner surface of conductive column 2A is one and one-fourth inches.

FIG. 4 shows the ratio of the relative humidity of the inlet air 14 to the relative humidity of the outlet air 17 as a function of voltage applied to conductor 10. (Although the upper corona discharge array 11 has not been operated simultaneously with corona discharge array 5, it is believed that a modest improvement in efficiency of removing moisture from the air will be attained.) In FIG. 4, solid line 46 shows the results for a positive voltage applied to the center electrode 5, while the dotted line 45 indicates the inlet-to-outlet humidity ratio when a negative voltage is applied to center electrode 5.

The curves 45 and 46 of FIG. 4 show that as the amplitude of the applied voltage begins to exceed about 15 kilovolts for either positive or negative applied voltages, the humidity extraction device shown in FIG. 1 begins to effectively remove moisture from the air. The improvement in moisture extraction increases rapidly with increasing applied voltage amplitudes up to about 25 kilovolts.

The 25 kilovolt potential used in these experiments is not the maximum that can be used, but rather represents the limits of the equipment available in the laboratory. Higher voltages would be expected to increase the efficiency of the system.

Figure 1A:
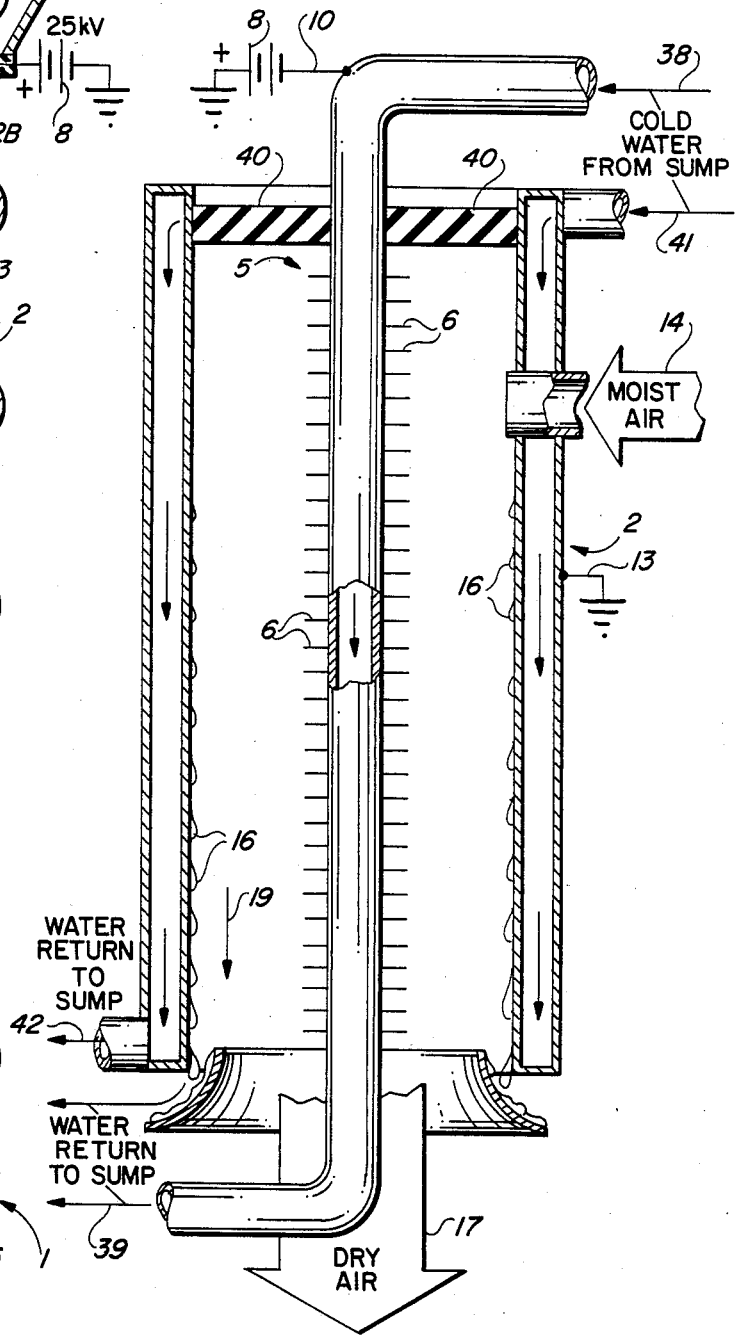
FIG. 1A is a section view of an alternate embodiment of the dehumidification apparatus of the present invention.

Those skilled in the art will realize that if vapor polar molecules condense to form microdroplets on the corona discharge array needles 6, the latent heat of condensation of the molecules is released and must be dissipated. Otherwise, the temperatures will rise, tending to cause re-evaporation of the droplets into the air. To solve these problems, a modified version of the above device can be provided, as shown in FIG. 1A, wherein the center electrode 5 of the corona discharge array is hollow, and cold water from a sump or other water source flows as indicated by arrow 38 through the center electrode 5, and is returned to the sump, as indicated by arrow 39, thereby cooling the corona discharge array needles 6 and removing the latent heat of condensation released by the gas-to-liquid phase change. If the discharge needles 6 are kept colder than the condensation point of the polar water molecules of humid air 14 in FIG. 2, the action of electric field 22 is the same on the polar water molecules as on the above-described droplets 23, and the polar molecules move to and condense on the shank of the needle 6.

It also is advantageous to keep the outer grounded collector 2 cool, to prevent or reduce re-evaporation of the droplets 16 that migrate from the ends of corona discharge needles 6 to the collector 2. To effectuate this, spiral cooling tubes, such as tubes 3 shown in FIG. 1, can be provided. Alternatively, an annular collector structure as shown in FIG. 1A can be provided wherein cold water from the sump enters the device, as indicated by arrow 41. After circulation of the cold water in the housing 2, which forms a water jacket, the water returns to the sump as indicated by arrow 42. Insulator 40 supports center electrode 5 and electrically insulates it from housing 2.

Yet another variation of the above-described structure is shown in FIG. 5, wherein the conductive pointed needles 6 are attached to an outer cylindrical wall 50 and are oriented radially inwardly. The collector to which droplets repulsed from the tips of the needles 6 migrate, in accordance with the above-described principles, has the form of an electrically grounded conductive tube 51 that is disposed coaxially with respect to the cylindrical emitter structure 50, as shown in FIG. 5. The conductive droplet emitting structure 50 is connected to a positive 25 kilovolt voltage source 8 by a conductor 10. As before, reference numerals 16 designate droplets that have collected on the collector. Reference numerals 38 designate cold water from a sump moving through the annular "water jacket" structure of emitter 50. Reference numeral 39 designates the return of the cold water to the sump. Reference numeral 41 designates cold water moving through the collector tube 51, and reference numeral 42 designates the return of that water to a sump.

The structure of FIG. 5 has been tested and shown to effectively extract water mist from moist air. However, accurate data comparing the efficiency of the structure of FIG. 5 with the structures of FIGS. 1 and 1A has not yet been obtained. It is believed, however, that the structure of FIG. 5 may have the advantage that less of the water collected in the form of droplets 16 will re-evaporate into the air medium passing through the structure because of the smaller amount of surface area of the collector 51 in FIG. 5.

The structure shown in FIG. 5 can be manufactured at reasonably low cost by utilizing a numerically controlled punch to punch holes in the conductive material forming the inner surface of the cylindrical emitter structure 50 while it is in the form of a flat sheet, and insert the needles 6, all having a precise length, into the holes formed thereby before forming the cylindrical structure.

As indicated above, re-evaporation of droplets as a result of increasingly dry air 14 passing through the device is a problem that decreases the efficiency of the humidification device 1. It therefore is important to provide rapid and effective means of removing liquid droplets from the influence of both the air 14 and the heat of condensation as rapidly as possible.

Possible mechanisms for removing liquid droplets include the above-mentioned natural movement of the droplets along the shank of the needle toward the sharpened point under the influence of the ambient electrical field. If the needle is coated with a hydrophobic material, for example, Teflon, it is thought that this process can be enhanced.

Once the droplets are in free space as a result of being electrostatically repelled from the tip portion of the corona discharge needles 6, accelerating the repelled droplets (which have accumulated electrical charge from the needles) to the conductive collector wall as rapidly as possible can be effectuated by providing one or more conductive, porous secondary accelerator screens such as 30 in FIG. 3 connected to an intermediate voltage 8A to further accelerate droplets such as 25A in the directions of arrows 27 toward the collector. The openings in such accelerating screens must, of course, be large enough to allow the microdroplets to pass through.

Use of an impeller such as 53, which is coaxially mounted with the center tube or rod of corona discharge array 5, to produce rotation of the incoming moist air 14 as it moves downward through the corona discharge array 5, will produce a centrifugal force on the droplets such as 25A in FIG. 2, boosting or enhancing their outward migration to the conductive wall 2A.

Another possible mechanism for removing collected droplets from the influence of the increasingly dry air 14 is the use of a porous wall, as shown in FIG. 3, in the collector, with a vacuum pump 36 being used to "suck" air 14 into a plenum 34A of the collector structure 34, as indicated by arrows 32 and 33. The dry air then is exhausted through an outlet 37 of the vacuum pump. In FIG. 3, the grounded porous conductive wall 20A would be porous, having closely spaced openings approximately 5 mils in diameter, so as to allow the gas stream or air stream 14 to be sucked into the plenum 34, while the surface tension of the accumulated droplets 29 prevents them from passing into the plenum 34. The accumulated droplets 29 then can drip or run downward as a result of the force of gravity, and be collected by the drip tray 15.

Another possible expedient (not shown) would be the provision of a spiral opening on the outer surface of the inner collector wall, opening into an aligned, slotted spiral tube so that droplets 29 sliding downward on the face of collector 20 (FIG. 2) will enter the spiral opening and flow into the spiral tube, and hence out of the influence of the air stream 14. This would greatly reduce further re-evaporation of the extracted liquid.

While the above described embodiment of the invention and the above-mentioned experimental results have been obtained only for removing water mist from air, I believe that the basic technique described above is generally applicable to most or all mists the microdroplets of which have a substantial permanent or induced dipole moment. More specifically, I believe that the mist in a large number of types of industrial gases, cleaning agents and the like are large enough, especially when enhanced by the presence of a strong electric field, can be shown to be extractable by the above described apparatus and technique, provided the temperatures of the corona discharge array and the collecting surface are maintained below the heat of condensation of the removed liquid.

It should be noted that the above-described technique when used with water vapor results in producing a quantity of pure water. It is expected that one of the applications of the above-described general apparatus and general technique could be economically used to provide small quanitites of fresh water.

Tests of the condensed water with a pH meter have indicated that it has a pH of 7, essentially that of normal water, neither acid nor alkali.

If the gas stream contains flammable gases, it is imperative that no electrical arcing occur, despite the high electric fields that are required to effectuate condensation in the manner described. This can be achieved by using pulsed modes of applying the high voltages to the needles of the corona discharge array and by providing a resistance in series with the needles. In this manner, arcing can be prevented even at very high applied voltages.

As indicated above, there are two basic mechanisms associated with the electric field produced by the corona discharge array and the presence of a gaseous medium containing microdroplets. One is the migration of the droplets toward the shank of the corona discharge needles. The other is the collection of charge by coalesced liquid particles on the shank of the needle and their movement under the influence of the ambient electrical field toward the tip of the needle and their ultimate repulsion from the needle as a result of the increasing electrostatic forces thereon and the collection of the repelled droplets by the collector.

It is known that an apparatus which is a variation of the structures described above can be utilized to "defog", or remove mist droplets from large volumes of air by utilizing the above-described separation mechanism. Experimental apparatus for the condensation of fog (saturated steam) is shown in FIG. 6. For example, slow AC potentials applied between the droplet collector and the needles should cause the extraction process of the present invention to occur, provided the AC variations are substantially longer in duration than the transit times of repulsed droplets from the needles to the collector surface.

FIG. 6 diagramatically illustrates a practical apparatus using this principle. In FIG. 6, a motor 56 drives a blower 57 that forces fog containing minute droplets 64 into a corona discharge array 58. The apparatus is disposed on the ground 55 in a region in which the lack of visibility caused by fog particles 64 can be eliminated, such as at a traffic intersection, a helicopter landing pad, or near the touch-down point of an aircraft runway. Alternately, the structure can be mounted on a vehicle.

Corona discharge array 58 includes a large number of pointed needles 6, as previously described, mounted on a conductive screen 61. Conductive screen 61 is connected by conductor 60 to a high voltage power supply 59, which may provide 25 kilovolts or more. A grounded screen 62 is spaced a predetermined distance from the points of needles 6, and is connected to an electric ground by conductor 63. Reference numeral 65 shows how the blower 57 forces fog containing minute fog droplets 64 through the screen 61 and by the high voltage needles 6. The above-described mechanism causes the minute droplets 64 to coalesce on the shanks of the needles 6, increase in size, and be repulsed, providing larger droplets 66 in the region between grounded collector screen 62 and the tips of needles 6. The force of the gaseous medium movement caused by blower 57 causes the droplets to pass through openings in grounded screen 62. The droplets 66 tend to coalesce, forming larger droplets 68 at the outlet of the device, which larger droplets 68 are carried in the direction of arrows 67. Thus, the system shown in FIG. 6 results in a net increase in the size of the droplets constituting the fog or mist that results in a modification of the optical properties of the droplets, so that optical scattering of light thereby now occurs in the infrared region of the spectrum, rather than the visible region. Thus, although the net moisture content of the foggy air has not necessarily been reduced in the region to the right of corona discharge array 58 in FIG. 6, the human eye can nevertheless see through the air because the droplets are larger. They are also heavier, and tend to fall to the ground.

Thus, in accordance with the present invention, a technique has been provided for extracting microdroplets in which dipole moments can be induced, to enhance coalescence into droplets that then can be removed from the gaseous medium. This has been accomplished with a relatively simple, inexpensive apparatus that requires far less energy to operate than previous devices for removing droplets from a gaseous medium. In many instances, the liquified extractant may have commercial value. In instances wherein contaminants are removed from air which humans or animals must breathe, the cost of filtering and/or reheating air to satisfactory temperatures is avoided, since the apparatus of the present invention does not refrigerate the air in the process of removing the contaminants.

While the invention has been described with reference to a particular embodiment thereof, those skilled in the art will be able to make various modifications to the described embodiments without departing from the true spirit and scope of the invention.

I claim:

1. A method of extracting droplets from a gaseous medium, the method comprising the steps of:

(a) providing a plurality of conductive, elongated, pointed elements each aimed directly at a conductive collector element and applying a voltage between the collector element and the plurality of pointed elements, creating an electric field;

(b) moving the gaseous medium between the pointed elements and the collector element;

(c) causing droplets in the gaseous medium to move toward and coalesce into droplets on shanks of the pointed elements under the influence of the electric field;

(d) causing the coalesced droplets to move along the shanks toward pointed tips of the pointed elements;

(e) causing the coalesced droplets to accumulate electrical charges from the pointed elements and be electrostatically repelled from the pointed elements toward the collector element as they approach high electric field intensity regions near the pointed tips;

(f) moving the repelled droplets to the collector element where they are collected thereon; and (g) removing the collected droplets from the collector element before they re-evaporate into the gaseous medium.

2. The method of claim 1 including exhausting the gaseous medium from the region between the collector element and the pointed elements.

3. The method of claim 2 wherein step (c) includes applying the voltage between the collector element and the pointed elements to produce sufficient electric field intensity to cause a large number of the droplets to move toward and coalesce on and form a large number of droplets on the shanks.

4. The method of claim 3 including removing heat from the collector element to maintain the temperature thereof below the evaporation point of the droplets moved to the collector element.

5. The method of claim 3 including providing a conductive porous intermediate accelerator element between the collector element and the pointed elements to increase the electric field intensity between the collector element and the pointed elements and thereby increase the velocity of the repelled droplets toward the collector element.

6. The method of claim 3 including pulsing the voltage applied between the pointed elements and the collector element and increasing the magnitude of the voltage. A duty cycle of the pulsed voltage being sufficiently low to prevent arcing between the pointed elements and the collector element.

7. The method of claim 3 including providing a porous surface on the collector element and drawing the gaseous medium through the porous surface while retaining the collected droplets on the porous surface and causing the droplets to move along the porous surface under the influence of gravity and drip into a container.

8. The method of claim 3 wherein the gaseous medium is air.

9. The method of claim 3 wherein the droplets include water droplets.

10. The method of claim 3 wherein the droplets constitute solvent droplets.

11. The method of claim 3 wherein the pointed elements are supported on a metal rod and are radially disposed thereon, and wherein the collector element is cylindrical and coaxial with the metal rod.

12. The method of claim 3 wherein an electric field intensity between the pointed elements and the collector element is in the range from 0.5 to 3 million volts per meter.

13. An apparatus for extracting droplets from a gaseous medium, the apparatus comprising in combination:

(a) a conductive collector element;
(b) a plurality of elongated, conductive, pointed elements, each pointed at the collector element;
(c) means for moving the gaseous medium between the pointed elements and the collector element;
(d) means for producing an electric field between the collector element and the poiqted elements to cause droplets of the gaseous medium to move toward shanks of the pointed elements and coalesce and form droplets on the shanks;
(e) means for causing the coalesced droplets to move along the shanks toward pointed tips of the pointed elements, the droplets accumulating electrical charge from the pointed elements;
(f) means for electrostatically repelling the coalesced droplets from the pointed elements when they move close to the pointed tips;
(g) means for moving the repelled droplets to the collector element where they are collected thereon; and
(h) means for removing the droplets moved to the collector element from the collector element before they re-evaporate into the gaseous medium.

14. The apparatus of claim 13 including means for removing heat from the collector element to maintain the temperature thereof below the evaporation point of the droplets moved to the collector element.

15. The apparatus of claim 13 further including a conductive porous intermediate accelerator element disposed between the collector element and the pointed elements to increase the electrical field intensity between the collector element and the pointed elements and thereby increase the velocity of the repelled droplets toward the collector element.

16. The apparatus of claim 15 wherein the collector element includes a porous surface and further includes means for causing the gaseous medium to move through the porous surface, the openings in the porous surface being sufficiently small to prevent collected droplets from passing through the porous surface, the droplets sliding downward along the porous surface under the influence of gravity and into a container.

17. The apparatus of claim 13 wherein the pointed elements are supported on a conductive cylinder and are radially disposed thereon, and wherein the collector element includes a conductive cylindrical housing surrounding and coaxial with the conductive cylinder.

18. The apparatus of claim 17 wherein the pointed elements are composed of copper and the conductive cylinder supporting the pointed elements is composed of copper.

19. The apparatus of claim 13 wherein the pointed elements are coated with material from the group consisting of hydrophobic material, hydrophilic material, and hydroscopic material.

20. A method of extracting mist from a gaseous medium, the method comprising the steps of:

(a) providing a plurality of conductive elongated pointed elements each aimed directly at a porous conductive element and applying a voltage between the conductive element and the plurality of pointed elements, creating an electric field;
(b) moving the gaseous medium by the pointed elements and through the conductive element inducing a dipole moment in droplets constituting the mist, causing the droplets constituting the mist to move to shanks of the pointed elements;
(c) causing the droplets to move along the shanks toward pointed tips of the pointed elements coalescing as they move to form larger droplets;
(d) causing the droplets to accumulate electrical charges from the pointed elements and be electrostatically repelled from the pointed elements toward the conductive element as they approach high electric field intensity regions near the pointed tips; and
(e) moving the repelled droplets to and through the conductive element.

21. A method of extracting polar molecules from a gaseous medium, the method comprising the steps of:

(a) providing a plurality of conductive, elongated, pointed elements each aimed directly at a conductive collector element, and applying a voltage between the collector element and the plurality of pointed elements, creating an electric field;
(b) moving the gaseous medium between the pointed elements and the collector element;
(c) causing polar molecules in the gaseous medium to move toward and condense into droplets on shanks of the pointed elements under the influence of the electric field;
(d) removing heat of condensation from the pointed elements to maintain the pointed elements below the condensation point of the polar molecules;
(e) causing the condensed droplets to move along the shanks toward pointed tips of the pointed elements;

(f) causing the condensed droplets to accumulate electrical charges from the pointed elements and be electrostatically repelled from the pointed elements toward the collector element as they approach high electric field intensity regions near the pointed tips;

(g) moving the repelled droplets to the collector element where they are collected thereon; and (h) removing the collected droplets from the collector element before they re-evaporate into the gaseous medium.

22. An apparatus for extracting polar molecules from a gaseous medium, the apparatus comprising in combination:

(a) a conductive collector element;

(b) a plurality of elongated, conductive, pointed elements, each pointed at the collector element;

(c) means for moving the gaseous medium between the pointed elements and the collector element;

(d) means for producing an electric field between the collector element and the pointed elements to cause polar molecules of the gaseous medium to move toward shanks of the pointed elements and condense and form droplets on the shanks;

(e) means for removing sufficient heat of condensation from the pointed elements to maintain the pointed elements below the condensation point of the polar molecules;

(f) means for causing the condensed droplets to move along the shanks toward pointed tips of the pointed elements, the droplets accumulating electrical charge from the pointed elements;

(g) means for electrostatically repelling the condensed droplets from the pointed elements when they move close to the pointed tips;

(h) means for moving the repelled droplets to the collector element where they are collected thereon; and (i) means for removing the collected droplets from the collector element before they re-evaporate into the gaseous medium.

* * * * *